United States Patent [19]

Wulff

[11] Patent Number: 4,691,184

[45] Date of Patent: Sep. 1, 1987

[54] BIMETAL RELEASER

[75] Inventor: Hans-Jürgen Wulff, Hohenwestedt, Fed. Rep. of Germany

[73] Assignee: Licentia Patent-Verwaltungs-GmbH, Frankfurt am Main, Fed. Rep. of Germany

[21] Appl. No.: 866,754

[22] PCT Filed: Sep. 20, 1985

[86] PCT No.: PCT/EP85/00492

§ 371 Date: May 27, 1986

§ 102(e) Date: May 27, 1986

[87] PCT Pub. No.: WO85/02197

PCT Pub. Date: Apr. 10, 1986

[30] Foreign Application Priority Data

Sep. 26, 1984 [DE] Fed. Rep. of Germany ..... 3435228

[51] Int. Cl.[4] ..... H01H 61/00; H01H 71/16

[52] U.S. Cl. ..... 337/49; 337/62; 337/82

[58] Field of Search ..... 337/49, 48, 46, 62, 337/82

[56] References Cited

FOREIGN PATENT DOCUMENTS 230980 1/1964 Austria ..... 337/49

3149811 7/1983 Fed. Rep. of Germany .

*Primary Examiner*—Harold Broome

*Attorney, Agent, or Firm*—Spencer & Frank

[57] ABSTRACT

A method for calibrating a bimetal releaser for a switch, e.g. a motor protection switch, the releaser including a release bridge and a differential bridge which is movable relative to the release bridge, with the ends of the bimetal strips being disposed between the two bridges through the use of calibrating elements. In order to provide a reliably adjusted bimetal releaser and to reduce the costs involved with adjustment, the free release end of each bimetal strip is equipped with a single calibrating element which, when the releaser is in its calibrated state, is fixed to the bimetal strip and, when seen in the direction of movement of the bimetal strip, lies, on the one hand, at the release bridge and, on the other hand, at the differential bridge.

11 Claims, 12 Drawing Figures

BIMETAL RELEASER

The invention relates to a bimetal releaser for excess currents as defined in the preamble of claim 1. Such a releaser is disclosed, for example, in DE-OS No. 3,149,811. In the known configuration, separate calibrating elements are provided on both sides of each bimetal strip, each disposed in unilaterally open chambers of the release bridge on the one hand and the differential bridge on the other hand. These calibrating elements are arranged opposite one another and are in contact with the bimetal strip. After adjustment, the bimetal strips are encased in a hardening plastic mass. These calibrating elements have such a configuration and are held in the chambers in such a manner that, during the calibrating or adjustment process, they lie in a form and force locking manner and under the influence of force simultaneously at both sides of each bimetal strip. The initially loosely arranged calibrating elements are to be fixed in such a manner that, if all available bimetal strips are heated uniformly, the subsequently connected switch lock of a switch is actuated only if the release bridge and the differential bridge have exceeded the set calibration position due to the joint action of all bimetal strips. If one current phase is missing, for example, the release bridge is to be held back and only the differential bridge is to be deflected to such an extent that the switch lock is released.

It is the object of the invention to provide a reliably adjusted bimetal releaser of the above-mentioned type and to reduce the costs involved in the adjustment. The object of reducing the calibration expenditures for calibrating such a bimetal releaser is realized by providing the release end of each bimetal strip with an aperture for accommodating a calibrating element which, after being inserted into this aperture, is supported at the release bridge as well as the differential bridge and is freely movable in the opening if the bridge moves during the adjusting process until it is fixed after completion of the adjustment.

FIG. 1 is a side view and

FIG. 2 is a top view of an adjusted bimetal releaser. FIGS. 3 and 4 are two side views of the releaser according to FIG. 1 during the adjusting process.

FIGS. *5a* to *5c* show various embodiments of a bimetal at its release end.

Figure 6:
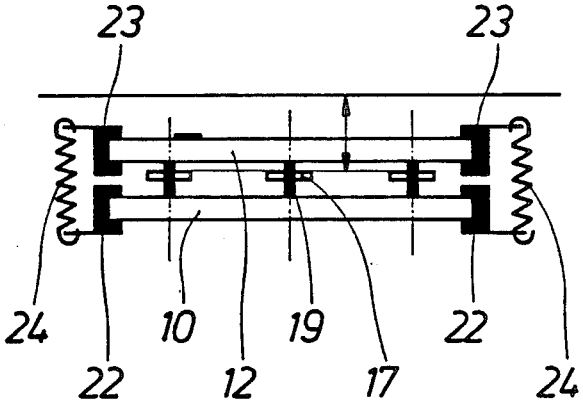
Figure 7:
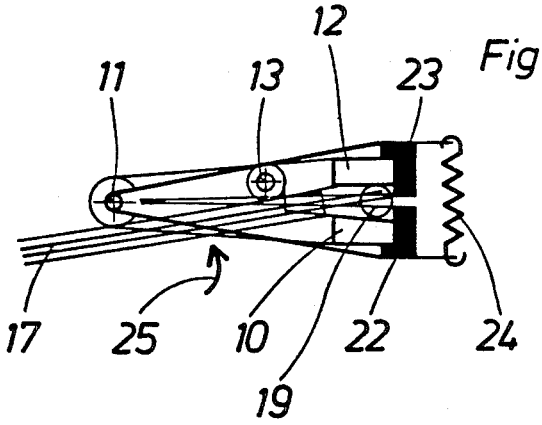
Figure 7A:
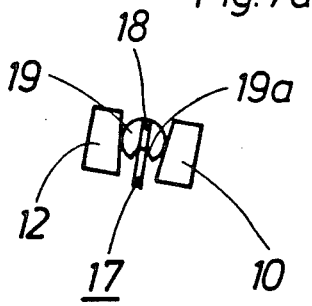

FIGS. 6 and 7 are schematic illustrations, a top view and a side view, of a device for deflecting the bimetal releaser according to FIGS. 1 to 4 during the calibration process.

FIG. *7a* shows a detail of FIG. 7.

Figure 9:
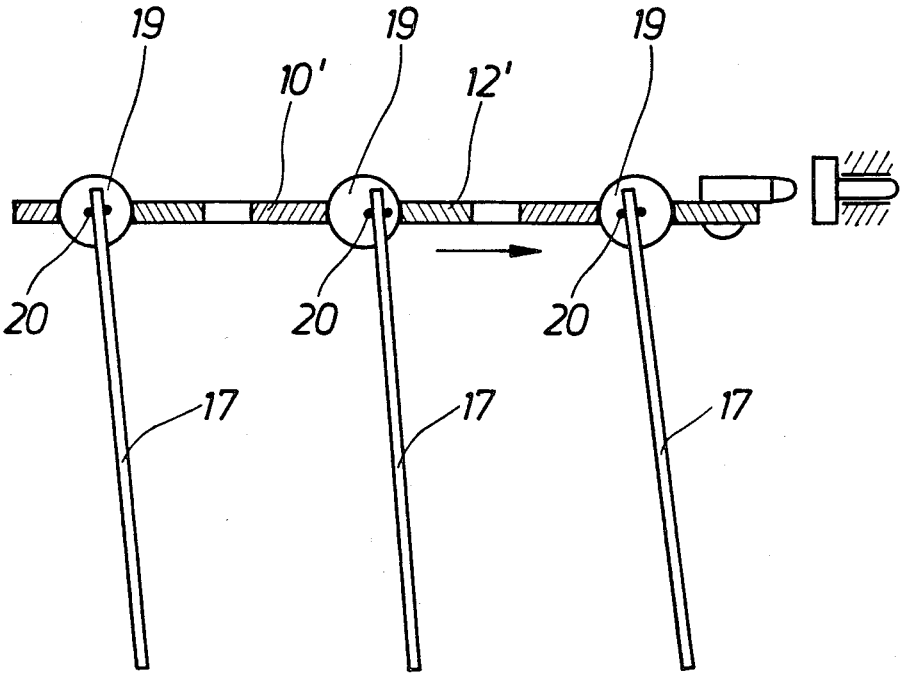
Figure 8:
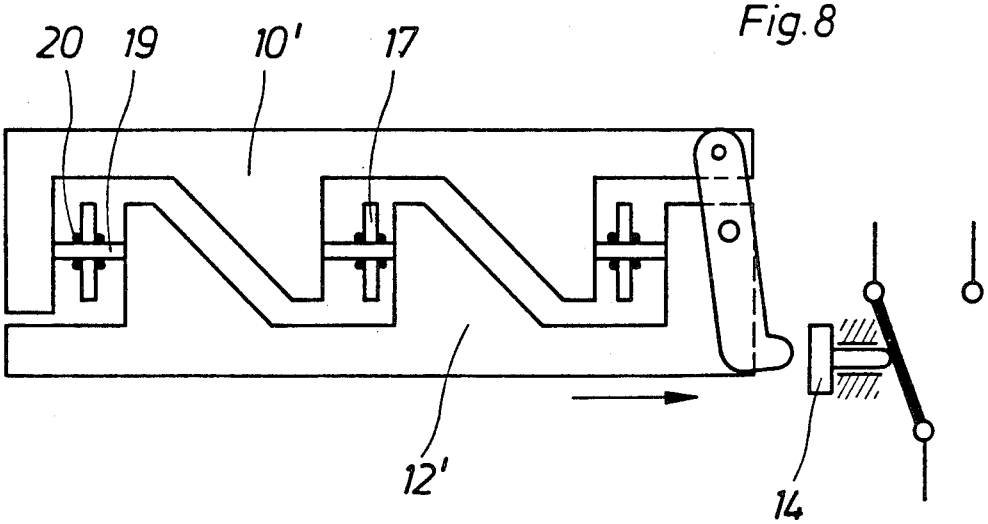

FIGS. 8 and 9 show a second embodiment.

Figure 1:
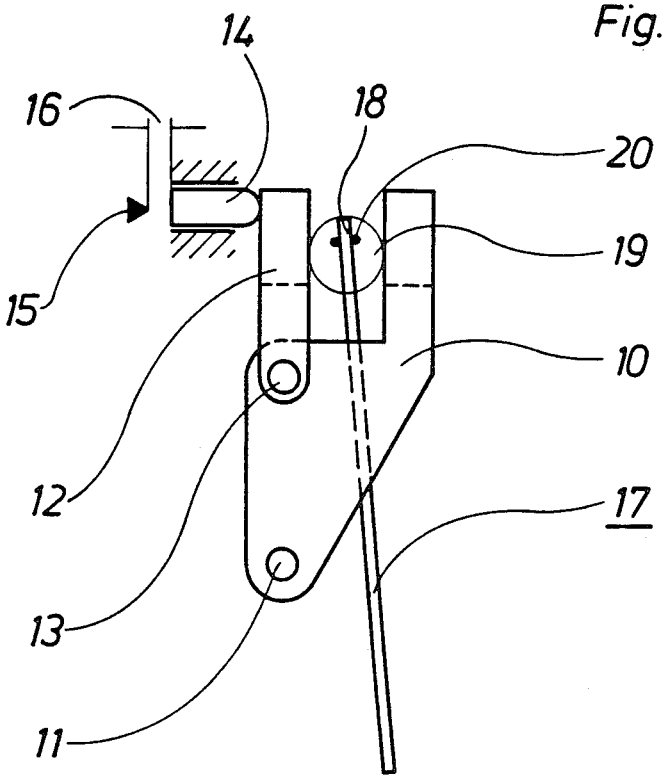
FIGS. 1 to 9 are schematic illustrations of an embodiment of the subject matter of the invention.

The bimetal releaser according to FIGS. 1 to 4 includes a release bridge 10 which is mounted at 11 in the housing or frame of a switch which is not illustrated. A differential bridge 12 is mounted at release bridge 10 so as to be rotatable about 13. The transfer lever 14 of a switch mechanism is disposed at differential bridge 12. This lever leads to a lock for a motor protection switch or a contact for a bimetal relay. The numeral 15 indicates the point of release of the switching mechanism which, in a motor protection switch, corresponds to release of a lock and, in a bimetal relay, to the point at which the contact snaps over. In FIG. 1, this point is spaced a distance 16 from the end of transfer lever 14.

Three bimetal strips 17 charged by the current of the three-phase excess current switch (not shown) are disposed between the two bridges 10 and 12. At release end 18, bimetal strips 17 are provided with calibration elements 19 in the form of discs which are fixed to the ends 18 of bimetal strips 17 by weld dots 20. Discs 19 are seated in apertures 21 which, according to FIG. *5a*, in this case are unilaterally open slits. The view of FIG. 2 shows the different positions of the three bimetal strips 17 with respect to bridges 10 and 12 caused by manufacturing tolerances.

Figure 2:
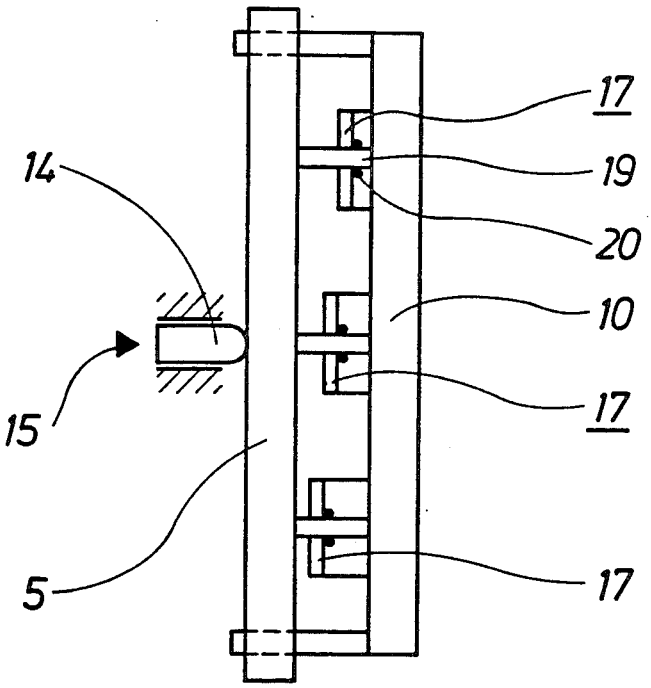
Figure 3:
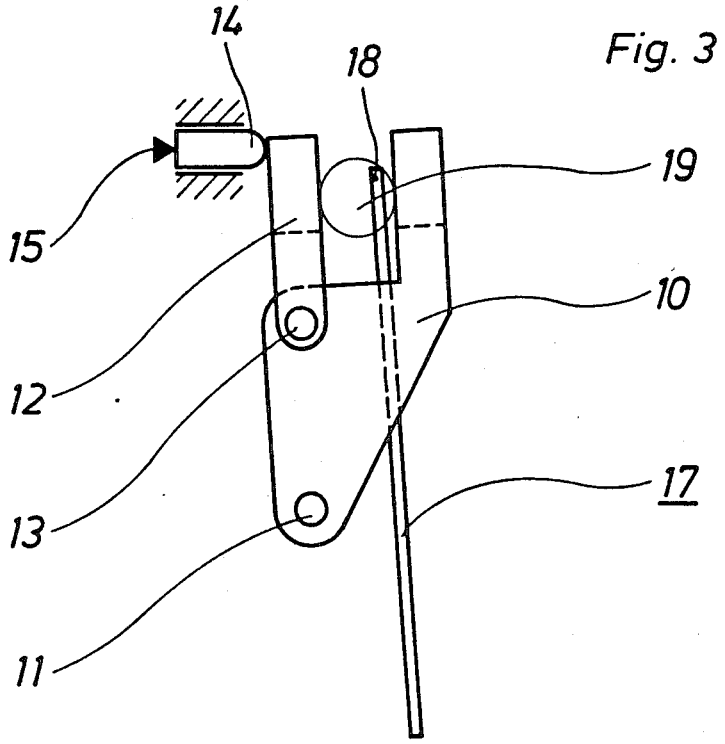
Figure 4:
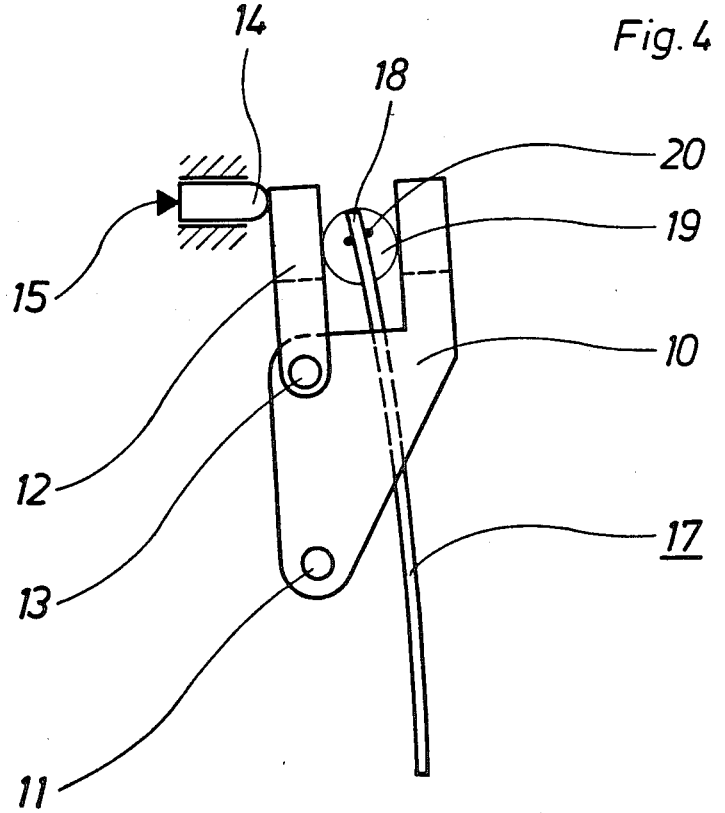
Figures 5A, 5B, 5C:
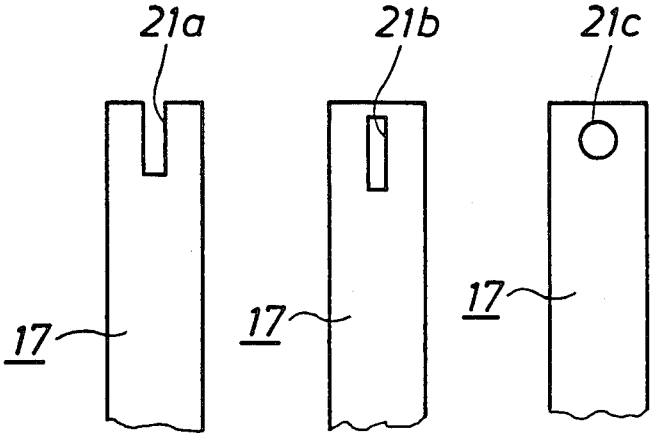

FIGS. 3 and 4 show two phases of the calibration process for establishing the calibrated state according to FIGS. 1 and 2. A device according to FIGS. 6 and 7 is employed here. This device is mounted at the center of rotation 11 of the release bridge and is equipped with pairs of claws 22, 23 associated with each bridge. Each pair of oppositely disposed claws 22 and 23 is connected together by means of a spring 24. According to FIGS. 3 and 4, the mutually facing walls of release bridge 10 and differential bridge 12 are parallel to one another. For the purpose of compensating tolerances, they may also be slightly conical, as shown in the detail view of FIG. *7a*.

For calibration, calibration elements 19 are placed loosely into apertures 21 of bimetal strips 17. Then, by means of the device according to FIGS. 6 and 7, they are brought into form locking contact with release bridge 10 and differential bridge 12. By rotating the device about point 11 in direction 25, bridges 10 and 12 and the calibrating elements 19 clamped between them are brought to the point of release 15 of the switch mechanism. This position is shown in FIG. 3. Upon release, the device is stopped and, in that position, bimetals 17 are brought, for example by heating, into the position in which the release must occur. This process is shown in FIG. 4. In this position, calibration elements 19 are fixed to the bimetals, for example by laser welding (weld dots 20).

With the present invention, the advantage is realized that not more than one calibration element is required per bimetal strip. Thus, and due to the manner of arranging this calibration element at the bimetal strip, calibration expenditures are reduced and it is possible to effect a very simple and reliable adjustment.

FIGS. 8 and 9 show an embodiment in which the bimetal strips 17 and the calibrating elements 19 attached to the ends thereof are arranged one behind the other in the direction of bending. Release bridge 10' and differential bridge 12' are configured as slides which lie in one plane and are displaceable in that plane. The ends of bimetal strips 17 bearing calibration elements 19 are each disposed in individual, separate recesses between slides 10', 12'. Otherwise the device operates correspondingly to the first-mentioned embodiment according to FIGS. 1 to 7.

The method for effecting the calibration likewise corresponds in principle to that for the first-mentioned embodiment, with the device for implementing the method having to be adapted to correspond to the changed position of the bimetal strips.

I claim:

1. A method for calibrating a bimetal releaser for a switch, the releaser including a release bridge pivotable about an axis, a differential bridge movable relative to the release bridge, a plurality of bimetal strips each having a free release end movable in a given direction as a function of the temperature of said bimetal strip, and a plurality of calibration elements each mounted at the free release end of a respective bimetal strip and interposed between the release bridge and the differential bridge, the differential bridge being movable into a switch release position when at least one of the bimetal strips is brought to a given temperature, said method comprising:

mounting each calibrating element at the free release end of a respective bimetal strip so as to be movable relative to its respective bimetal strip;

bringing each calibrating element into contact with the release bridge and the differential bridge;

moving the release bridge, the differential bridge and the calibrating elements about the release bridge axis to bring the differential bridge to the switch release position;

while maintaining the differential bridge in the switch release position, bringing the free release end of each bimetal strip to the position corresponding to the given temperature; and fixing each calibrating element to its associated bimetal strip while said strip and said differential bridge are in respective positions corresponding to the given temperature and the release position, respectively, and said calibrating element is in contact with said differential bridge.

2. A method as defined in claim 1, wherein steps of bringing and moving are carried out by means of a device comprising: a first pair of claws enclosing said releaser bridge; a second set of claws enclosing said differential bridge; and spring means urging said sets of claws toward one another.

3. A method as defined in claim 1, wherein said step of fixing is carried by gluing each said calibrating element to its associated bimetal strip.

4. A method as defined in claim 3 wherein the gluing is effected with a quick hardening adhesive.

5. A method as defined in claim 1 wherein said step of fixing is carried out by welding each said calibrating element to its associated bimetal strip.

6. A method as defined in claim 5 wherein the welding is an electric arc welding.

7. A method as defined in claim 5 wherein the welding is a laser welding.

8. A method as defined in claim 1 wherein each calibrating element has the form of a pin, disc or ball.

9. A method as defined in claim 1 wherein the free release end of each bimetal strip is provided with an aperture holding the associated calibrating element, the aperture having the form of a unilaterally open slit or an angular or circular opening.

10. A method as defined in claim 9 wherein each calibrating element is provided with a notch which cooperates with the aperture in the associated bimetal strip.

11. A method as defined in claim 9 wherein each calibrating element is supported in the aperture of its associated bimetal strip during said steps of bringing and moving such that each calibrating element contacts each bridge and is movable relative to its associated bimetal element.

* * * * *